US007282631B2

(12) United States Patent
Chou

(10) Patent No.: US 7,282,631 B2
(45) Date of Patent: Oct. 16, 2007

(54) HARNESS FOR SUPPORTING A MUSICAL INSTRUMENT

(76) Inventor: Wayne W. Chou, 25 Hauley Pl., Ridgefield, CT (US) 06877

( * ) Notice: Subject to any disclaimer, the term of this patent is extended or adjusted under 35 U.S.C. 154(b) by 87 days.

(21) Appl. No.: 11/115,919

(22) Filed: Apr. 27, 2005

(65) Prior Publication Data

US 2006/0243116 A1 Nov. 2, 2006

(51) Int. Cl.
*G10D 7/08* (2006.01)

(52) U.S. Cl. ..... 84/385 A

(58) Field of Classification Search ..... 84/385 A, 84/327, 329; 248/443
See application file for complete search history.

(56) References Cited

U.S. PATENT DOCUMENTS 4,298,149 A * 11/1981 Gottschalk et al. ..... 224/201
4,634,032 A * 1/1987 LaFlame ..... 224/265
5,400,683 A * 3/1995 LaFlame ..... 84/421
2006/0096443 A1* 5/2006 May ..... 84/421
2006/0186151 A1* 8/2006 May ..... 224/265

* cited by examiner

*Primary Examiner*—Kimberly Lockett
(74) *Attorney, Agent, or Firm*—Mark P. Stone

(57) ABSTRACT

A harness for supporting a musical instrument, and in particular, a weighty musical instrument such as a saxophone, has an anchor formed from a rigid or semi-rigid material having a curved portion adapted to be seated, in part, on the shoulders of a musician, and a rearwardly and downwardly extending tail portion adapted to receive a first adjustable strap extending around the body of the musician for retaining the anchor fixed relative to the musician. A second adjustable strap extending forwardly from two front ends of the anchor carries a hook for engaging a musical instrument.

17 Claims, 2 Drawing Sheets

HARNESS FOR SUPPORTING A MUSICAL INSTRUMENT

BACKGROUND OF THE INVENTION

The present invention is directed to improved means for supporting a musical instrument, and in particular a weighty instrument such as a saxophone, which is supported by the body of a musician for minimizing discomfort to the musician while he is holding the instrument. A saxophone is a weighty instrument, weighing in the order of about five pounds. A musician cannot comfortably sustain the weight of a heavy instrument for long periods of time in the same position so that the mouthpiece remains proximate to the mouth of the musician. It is known to provide an eye on the body of a musical instrument such as a saxophone to enable the eye to be engaged by a hook on a supporting neckstrap worn by the musician. The use of the neckstrap relieves the primary weight of the musical instrument from the arms and hands of the musician, thereby providing the fingers of the musician with greater freedom to operate the keys of the instrument since the hands and arms of the musician are not required to provide the primary support for the instrument. Known neck straps for supporting musical instruments are adjustable to enable the mouthpiece of the instrument to be placed in a fixed position relative to the mouth of the musician for substantially long periods of time. This is possible because the distance from the neck of the musician to the supporting eye on the instrument is relatively fixed and stable, and the distance between the neck and mouth of the musician is also substantially fixed for any given individual. However, even with a neck strap providing the primary support for the musical instrument, after long periods of time, the weight of the instrument bearing down on the back of the neck of the musician becomes tiring and stressful on the muscles surrounding the neck, and also causes the neck strap to press against the carotid arteries of the musician on both sides of the neck. On occasion, the weight of a musical instrument such as a saxophone bearing down on a supporting neckstrap has caused musicians to pass out during playing sessions.

In order to improve the comfort of neck straps for heavy musical instruments, soft padding has been placed around the portion of the strap engaging the neck of the musician, and attempts have been made to redesign the supporting strap as a harness using more of the shoulders for support. While providing a harness to displace the weight of the instrument from the neck to the shoulders of a musician increases the musician's comfort, known harnesses are disadvantageous in certain respects. One of the requirements of playing an instrument is preventing unwanted motion between the mouthpiece of the instrument and the mouth of the musician. Such motion creates unwanted nuances to the tonal quality of the sound. Although the distance from the neck to the mouth or shoulders of a musician can be held steady, known harnesses to date provide no means for maintaining a constant distance between the supporting eye extending from the musical instrument to the shoulder of the musician. The known harnesses are formed from complex configurations of flexible webbing which, after a short period of time, shifts or displaces relative to the body position of a musician because there are no anchors holding any part of the web in a fixed position relative to the body of the musician. An example of a known harness type neck support is marketed under the trademark SLIDER by Slider Straps c/o LM Products 1325 Meridian, Anderson, Ind. 46013 (www.sliderstraps.com). U.S. Pat. No. 4,930,695 discloses another known harness-type strap formed from flexible webbing for supporting a musical instrument. A further disadvantage of the known harness-type supports having flexible webbing for supporting a musical instrument is that the harness can slip or slide off the shoulders of a musician during a performance since the harness includes no positive anchoring structure. Thus, although the known harness-type neck straps for supporting musical instruments improve the comfort to a musician, they nonetheless adversely affect the performance of the musician by requiring the musician to constantly re-position the harness during a performance in order to maintain the mouthpiece at a desired distance relative to the mouth of the musician.

The primary object of the present invention is to overcome the disadvantages of the known harness-type neck straps for supporting musical instruments on the body of a musician, and in particular, heavier musical instruments such as a saxophone.

Other objects and advantages of the present invention will become apparent to those skilled in the art from the following discussion in conjunction with the accompanying drawings.

SUMMARY OF THE INVENTION

The present invention provides improvements to known means for supporting a musical instrument on the body of a player or musician during a performance. In accordance with the preferred embodiment of the invention, the support for the musical instrument includes a rigid or semi rigid base or anchor formed from a substantially non-flexible material in a generally curved "Y" configuration in which the two forwardly extending front ends of the anchor are adapted to engage the two shoulders of the wearer, while the center or tail portion of the "Y" configuration extends rearwardly along the back of the wearer. The tail portion of the anchor includes means for receiving a first strap which extends around the chest and the back of the wearer and beneath the wearer's shoulders, and is oriented substantially transversely to the longitudinal orientation of the rearwardly and downwardly extending tail portion of the anchor. A second strap has two remote ends, and each of the remote ends engages one of the two opposed, forwardly extending front ends of the anchor. The second strap, in its operational position, extends downwardly along the chest of the wearer, and is adapted to carry an engagement element, such as a hook, for removably engaging a supporting element, such as an eye, extending from a musical instrument to be played by the wearer.

Preferably, the first strap is adjustable so that it comfortably engages the back and the chest of the wearer, and the second strap is also adjustable so as to enable the wearer to maintain the mouthpiece of the musical instrument at a fixed, predetermined distance from the mouth of the wearer. Because the first and second straps are adjustable, the support can be worn by different musicians having different body configurations by adjusting the straps to fit different individuals.

The musical instrument support in accordance with the present invention overcomes the disadvantages of the known prior art of harness-type supports for musical instruments by maintaining a fixed distance between the instrument and the wearer by preventing shifting or displacement of the harness relative to the wearer during a performance, while still advantageously applying the weight of the instrument primarily on the shoulders, and not the neck, of the wearer.

DESCRIPTION OF THE BEST MODES FOR CARRYING OUT THE INVENTION

Figure 1:
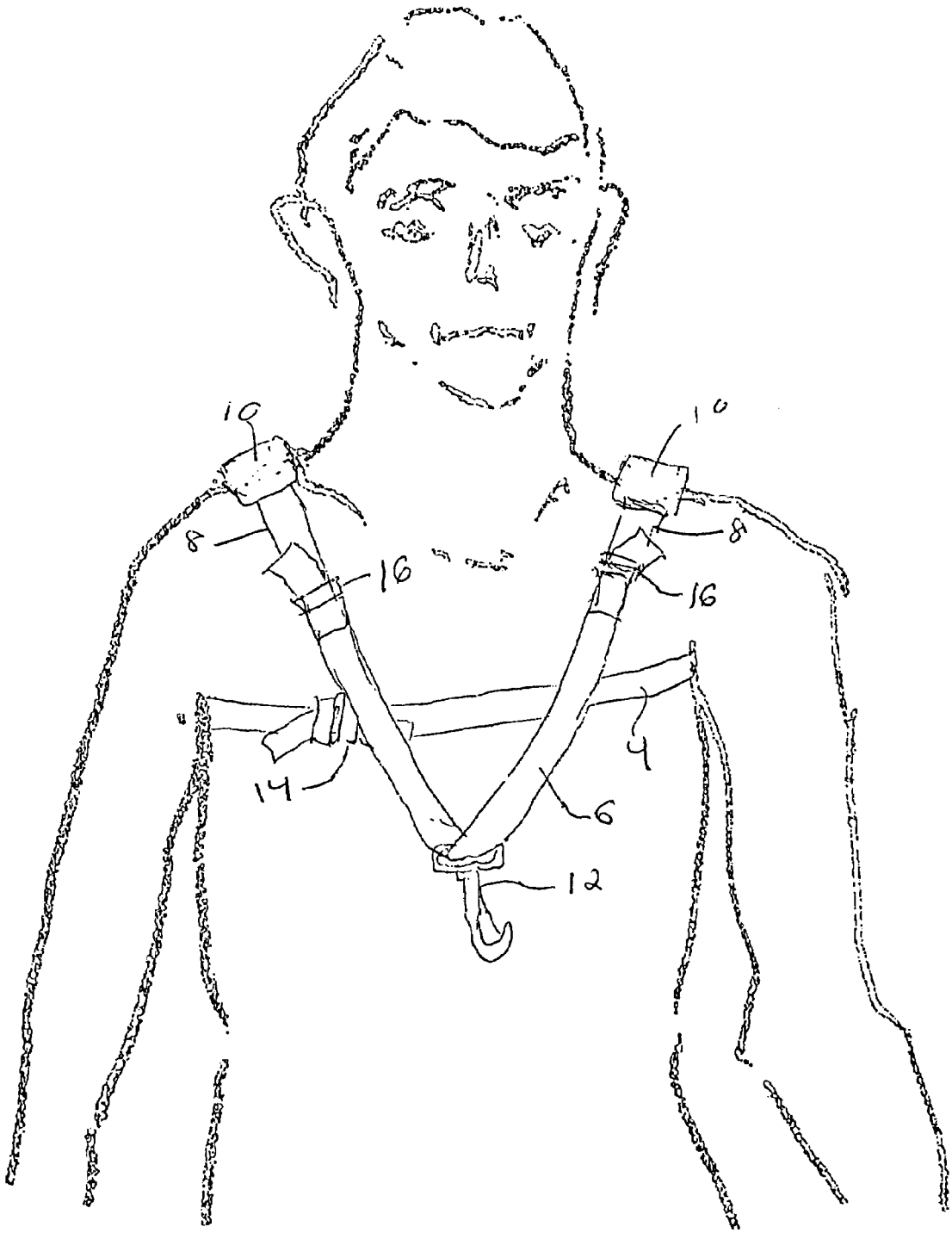
FIG. 1 illustrates the front of a person wearing the improved support for a musical instrument in accordance with the present invention.
Figure 2:
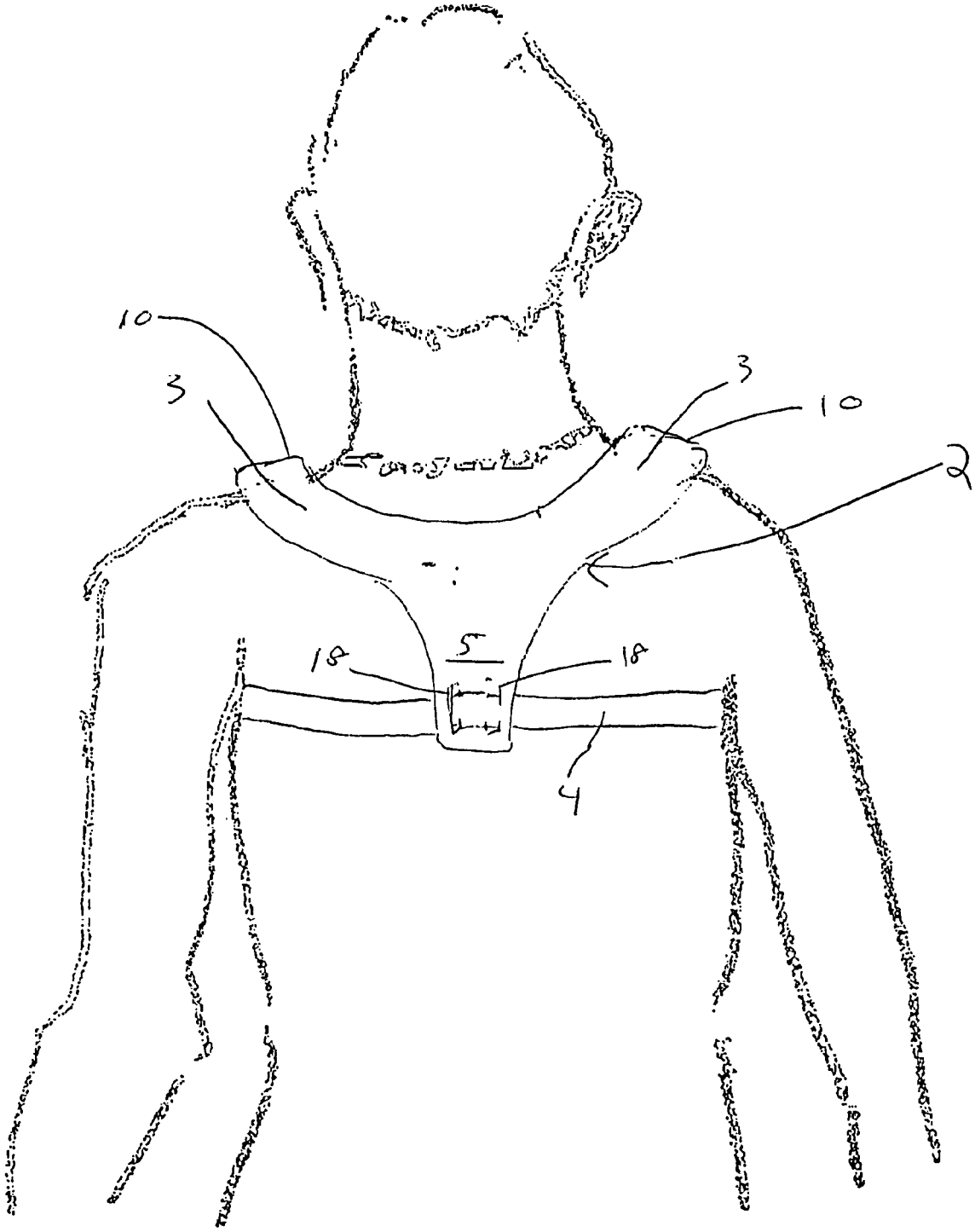
FIG. 2 illustrates the rear of the person illustrated in FIG. 1 wearing the improved support for a musical instrument in accordance with the present invention.

The preferred embodiments of the improved support for a musical instrument in accordance with the present invention are illustrated by FIGS. 1 and 2 of the drawings. These drawings illustrate both the front and back of an individual wearing a harness for supporting a musical instrument. The support for the musical instrument includes three basic elements, namely—a generally "Y" shaped anchor or base designated by reference numeral 2, having two forwardly extending arms 3 and a rearwardly extending tail portion 5 integrally joined to the arms 3; a first strap designated by reference numeral 4 which engages the rear portion of the anchor 2 and extends around the back and chest of the wearer; and a second strap designated generally by reference numeral 6 having remote ends 8, each of which respectively engage a different one of the forward ends 10 of the two arms 3 of the anchor 2. The anchor 2 is curved to fit around the neck of the wearer, and the arms 3 of the anchor 2 are adapted to engage the top of the shoulders of the wearer. The strap 6 extends over the chest of the wearer, and the center of the strap 6 engages and supports a connecting element 12 which, in the preferred embodiment of the invention, is a hook for removably engaging an eye attached to the musical instrument to be supported. When the support is worn by the wearer, the hook 12 is generally centrally positioned along the front of the wearer's torso. An adjustment element, such as the buckle designated by reference numeral 14, is provided to adjust the length of the first strap 4 extending around the chest and back of the wearer, and to permit the strap 4 to be removed from the wearer, as may be desired. A pair of adjustment elements, such as the buckles designated by reference numeral 16, are provided to removably attach the free ends 8 of the strap 6 to the free forward ends 10, respectively, of the arms 3 of the anchor 2, and also to adjust and fix the distance between the hook 12 and the mouth of the wearer. In this manner, a fixed, predetermined distance is maintained between the mouthpiece of a musical instrument supported by the hook 12, and the mouth of the wearer. The buckles 16 permit this distance to be adjusted, at the selection of the wearer, and also to quickly release the belt 6 from the forward ends 10 of the anchor 2, as may be desired.

As noted above, the belt 4 extending around the chest and back of the wearer engages the rear segment or tail portion 5 of the anchor 2 proximate to the bottom of the rear segment 5. In accordance with the preferred embodiment of the invention, two longitudinally oriented slots, designated by reference numeral 18, are defined in the rear segment 5 of the anchor for engaging and receiving the strap 4 extending therethrough. The slots 18 maintain the strap 4 oriented along a plane substantially perpendicular to the longitudinal plane of extension of the rear segment 5 of the anchor 2.

Although the anchor 2 is generally "Y" shaped, it is also curved to conform approximately to the shape of the back and the shoulders of the wearer. In the preferred embodiment of the invention, the underside of the anchor is padded with a suitable cushioning material such as foam or rubber so that it can be comfortably worn over the shoulders and the back of the musician. The "Y" shape of the anchor provides clearance for the neck of the wearer, and also defines the rearwardly and downwardly extending vertical tail portion 5 for engaging the horizontally oriented strap 4.

The anchor 2 is preferably formed from a substantially non-flexible and non-elastic rigid or semi-rigid material such as a thermo-plastic material, as for example, PVC or ABS. The non-flexible nature of the anchor, unlike the flexible webbing of the known prior art harnesses, prevents the anchor from stretching, shifting or displacing relative to the body of the wearer during a musical performance to maintain the fixed, predetermined distance between the hook 12 and the mouth of the wearer which corresponds to the desired distance between the mouthpiece of the musical instrument supported by the hook 12 and the mouth of the wearer.

In operation, the straps 4 and 6 of the instrument support are adjusted to fit a particular individual, and to select and fix the desired distance between the hook 12 and the mouth if the wearer. If the instrument support will be used only by the same individual, it is necessary to make the strap adjustments only once, while if the instrument support will be used by different individuals, the strap adjustments can be made to fit each individual using the instrument support. Once the adjustments are made, the hook 12 carried by the strap 6 is removably connected to the instrument to be supported, so as to maintain the mouthpiece of the instrument a fixed, predetermined distance relative to the mouth of the wearer. The weight of the connected instrument is distributed and applied to the forwardly extending arms 3 of the anchor 2 resting on the shoulders of the wearer. Because the anchor 2 is formed from a substantially non-flexible non-elastic rigid or semi-rigid material, it will not stretch or slip from the wearer's shoulders to displace or vary the relative position of the hook 12. On the contrary, because the anchor 2 is formed from a substantially non-flexible rigid or semi-rigid material, it is not possible to cause the strap 6 to be displaced downward because the anchor 2, and in particular the forwardly extending arms of the anchor 2, are rigid or semi-rigid and will not slip or stretch over the shoulders of the wearer. Although the weight of the instrument supported by the hook 12 creates a torque which tends to rotate the anchor 2 in a direction from the back to the front of the wearer using the wearer's shoulders as a pivot point, such rotation is prevented by the horizontal strap 4 which engages the bottom of the rear segment 5 of the anchor 2 to prevent rotation of the anchor and to maintain the anchor 2 in a fixed position relative to the body of the wearer.

Preferably, the straps 4 and 6 are formed from a substantially non-stretchable material such as nylon webbing to prevent stretching of the straps when the instrument support is worn on the body of the wearer.

Although the preferred embodiment of the invention discloses a "Y" shaped anchor, other configurations, including but not limited to a generally "U" shaped configuration, can also be employed in the musical instrument support of the present invention provided that the anchor is formed from a substantially non-flexible and non-elastic rigid or semi-rigid material.

Other improvements and advantages of the musical instrument support within the spirit of the present invention will become apparent to those skilled in the art. Therefore, the best mode for carrying out the invention discussed herein and shown by the drawings is intended to be illustrative, and not restrictive of the scope of the invention, that scope defined by the following claims and all equivalents thereto.

The invention claimed is:

1. A support for a musical instrument, said support comprising:

an anchor adapted to fit over the shoulders of a wearer, said anchor formed from a substantially non-flexible material, a connecting element engaging said anchor for coupling said anchor to a musical instrument for maintaining the musical instrument a predetermined, fixed distance from said anchor, said connecting element comprising a first strap connected to said anchor, said first strap oriented to extend forwardly of said anchor and down the front of a wearer, and means for removably connecting said first strap to said anchor.

2. The support as claimed in claim 1, wherein said anchor is formed from a semi-rigid material.

3. The support as claimed in claim 1, wherein said anchor is formed from a rigid material.

4. The support as claimed in claim 1, wherein said anchor is formed from a thermo-plastic material.

5. The support as claimed in claim 1, wherein said anchor comprises a first portion adapted to be seated on the shoulders of a wearer, and a second portion extending downwardly along the back of a wearer.

6. The support as claimed in claim 5, wherein said first and second portions of said anchor are integrally connected to each other.

7. The support as claimed in claim 5, wherein said anchor is generally "Y" shaped.

8. The support as claimed in claim 1, further including means for selectively adjusting the position of said first strap relative to said anchor.

9. A support for a musical instrument, said support comprising:

an anchor adapted to fit over the shoulders of a wearer, said anchor formed from a substantially non-flexible material, a connecting element engaging said anchor for coupling said anchor to a musical instrument for maintaining the musical instrument a predetermined, fixed distance from said anchor, said connecting element comprising a first strap connected to said anchor, said first strap oriented to extend forwardly of said anchor and down the front of a wearer, and a hook for engaging a musical instrument mounted to said first strap.

10. The support as claimed in claim 5, further including a second strap adapted to extend around a wearer, said second portion of said anchor including means for engaging said second strap for maintaining said second portion of said anchor in a fixed position relative to a wearer.

11. A support for a musical instrument, said support comprising:

an anchor adapted to fit over the shoulders of a wearer, said anchor formed from a substantially non-flexible material, a connecting element engaging said anchor for coupling said anchor to a musical instrument for maintaining the musical instrument a predetermined, fixed distance from said anchor, said anchor comprising a first portion adapted to be seated on the shoulders of a wearer, and a second portion extending downwardly along the back of a wearer, and a second strap adapted to extend around a wearer, said second portion of said anchor including means for engaging said second strap for maintaining said second portion of said anchor in a fixed position relative to a wearer, wherein said second strap and said second portion of said anchor are oriented substantially perpendicular to each other when said support is worn by a wearer.

12. The support as claimed in claim 11, further including means for adjusting the length of said second strap around a wearer and for removing said second strap from a wearer.

13. The support as claimed in claim 5, further including a padding material on said first and second portions of said anchor, said padding material oriented to directly engage the shoulders and back of a wearer.

14. A support for a musical instrument, said support adapted to be worn on the body of a wearer, said support comprising:

an anchor formed from a substantially non-flexible material, said anchor comprising a first anchor portion adapted to be seated on the shoulders of a wearer, and a second anchor portion adapted to extend downwardly and rearwardly along the back of a wearer, said first and second anchor portions being integrally connected to each other, a first connecting element for engaging said first anchor portion and a musical instrument for coupling said musical instrument to said anchor for maintaining said musical instrument at a fixed, predetermined distance from said anchor, and a second connecting element for engaging said second anchor portion for maintaining said second anchor portion in a fixed position relative to the wearer, said second connecting element being oriented substantially perpendicular to said second anchor portion.

15. A method of supporting a musical instrument in a fixed position relative to the body of a person, said method comprising the steps of:

mounting an anchor formed from a substantially non-flexible material over the shoulders of said person, connecting the anchor to a musical instrument by a first strap extending down the front of said person for maintaining a fixed distance between the musical instrument and said person, and preventing movement of said anchor relative to the body of said person by passing a strap through said anchor and extending the strap around the body of the person.

16. The method as claimed in claim 15, further including the step of selectively adjusting the fixed distance between said musical instrument and said person.

17. The method as claimed in claim 15, further including the step of providing means for adjusting the length of the strap extending around the body of said person and for removing said strap from the body of said person.

* * * * *